US008523595B2

(12) United States Patent
Wu

(10) Patent No.: US 8,523,595 B2
(45) Date of Patent: Sep. 3, 2013

(54) ELECTRONIC MODULE WITH IMPROVED LATCH MECHANISM

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 57 days.

(21) Appl. No.: 13/349,903

(22) Filed: Jan. 13, 2012

(65) Prior Publication Data

US 2012/0190223 A1 Jul. 26, 2012

(51) Int. Cl.
*H01R 13/627* (2006.01)

(52) U.S. Cl.
USPC ..... 439/352

(58) Field of Classification Search
USPC ..... 439/152, 352–357, 607.2
See application file for complete search history.

(56) References Cited

U.S. PATENT DOCUMENTS

| | | | | |
|---|---|---|---|---|
| 6,749,448 | B2 * | 6/2004 | Bright et al. | 439/160 |
| 6,824,416 | B2 | 11/2004 | Di Mascio | |
| 6,851,867 | B2 | 2/2005 | Pang et al. | |
| 6,884,097 | B2 * | 4/2005 | Ice | 439/160 |
| 6,908,323 | B2 * | 6/2005 | Ice | 439/160 |
| 7,052,306 | B2 | 5/2006 | Ishigami et al. | |
| 7,090,523 | B2 | 8/2006 | Shirk et al. | |
| 7,204,712 | B2 * | 4/2007 | Schwiebert et al. | 439/352 |
| 7,212,410 | B2 * | 5/2007 | Larson | 361/726 |
| 7,281,863 | B2 * | 10/2007 | Yamada et al. | 385/92 |
| 7,422,457 | B1 * | 9/2008 | Wu | 439/258 |
| 2009/0156058 | A1 * | 6/2009 | Wu | 439/607.18 |
| 2010/0091467 | A1 * | 4/2010 | Wu | 361/747 |
| 2010/0273335 | A1 * | 10/2010 | Wu | 439/80 |
| 2011/0003502 | A1 * | 1/2011 | Li et al. | 439/464 |
| 2011/0059645 | A1 * | 3/2011 | Wu | 439/460 |
| 2011/0086548 | A1 * | 4/2011 | Wu | 439/607.41 |
| 2011/0136368 | A1 * | 6/2011 | Wu | 439/345 |
| 2012/0045920 | A1 * | 2/2012 | Wu | 439/345 |
| 2012/0094515 | A1 * | 4/2012 | Wu | 439/159 |
| 2012/0106901 | A1 * | 5/2012 | Wu | 385/88 |
| 2012/0190224 | A1 * | 7/2012 | Wu | 439/157 |
| 2012/0218720 | A1 * | 8/2012 | Wu | 361/740 |
| 2012/0220152 | A1 * | 8/2012 | Wu | 439/350 |

* cited by examiner

*Primary Examiner* — Tho D Ta
*Assistant Examiner* — Larisa Tsukerman
(74) *Attorney, Agent, or Firm* — Wei Te Chung; Ming Chieh Chang

(57) ABSTRACT

An electronic module (100) for mating with a complementary connector, comprises: a housing defining a recess area and a printed circuit board (3) disposed in the housing. A slider member (61) is assembled to an exterior surface of the housing and defines a pair of curved arm portions (612) formed on a front section thereof and a connecting portion (613) connected with two front ends of the pair of curved arm portions, and each arm portion defines a protrudent portion (6120) formed on a top surface thereof. A gasket (5) is received into the recess area and engaged with the housing. Whereby movement of the slider by a user along a front to rear direction, the pair of curved arm portions are both straightened to make two protrudent portions moved upwardly.

20 Claims, 9 Drawing Sheets

ELECTRONIC MODULE WITH IMPROVED LATCH MECHANISM

BACKGROUND OF THE INVENTION

1. Field of the Invention

The present invention generally relates to an electronic module, and more particularly to an electronic module having an improved latch mechanism for high speed signal transmitting.

2. Description of Related Art

SFP (Small Form-factor Pluggable), X-SFP and QSFP are all modules for fiber optic transmission or ordinary signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle. When such a module embedded in a system fails, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above. However, another problem is raised, that is there is not enough space left for operator's finger operation.

Hence, an improved electronic module is highly desired to overcome the disadvantages of the related art.

SUMMARY OF THE INVENTION

Accordingly, an object of the present invention is to provide an electronic module having an improved latch mechanism to be separated from a complementary connector expediently.

In order to achieve the object set forth, an electronic module for mating with a complementary connector, comprises: a housing defining a recess area; a printed circuit board disposed in the housing; a slider member assembled to an exterior surface of the housing and defining a pair of curved arm portions formed on a front section thereof and a connecting portion connected with two front ends of the pair of curved arm portions, each arm portion defining a protrudent portion formed on a top surface thereof; a gasket received into the recess area and engaged with the housing; whereby movement of the slider by a user along a front to rear direction, the pair of curved arm portions are both straightened to make two protrudent portions moved upwardly.

Other objects, advantages and novel features of the invention will become more apparent from the following detailed description when taken in conjunction with the accompanying drawings.

DETAILED DESCRIPTION OF THE INVENTION

Figure 1:
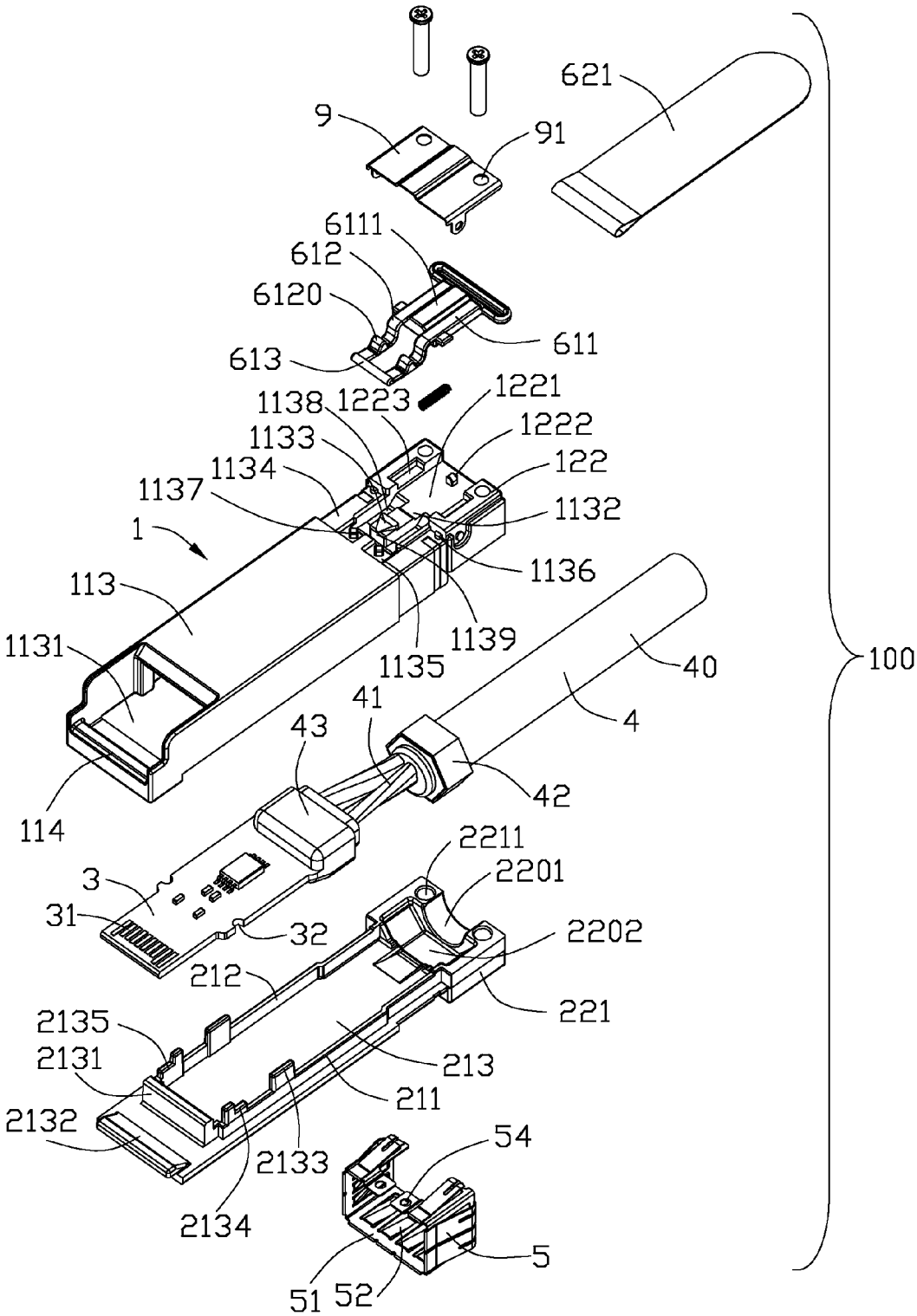
FIG. 1 is an exploded, perspective view of an electronic module in accordance with the present invention.
Figure 2:
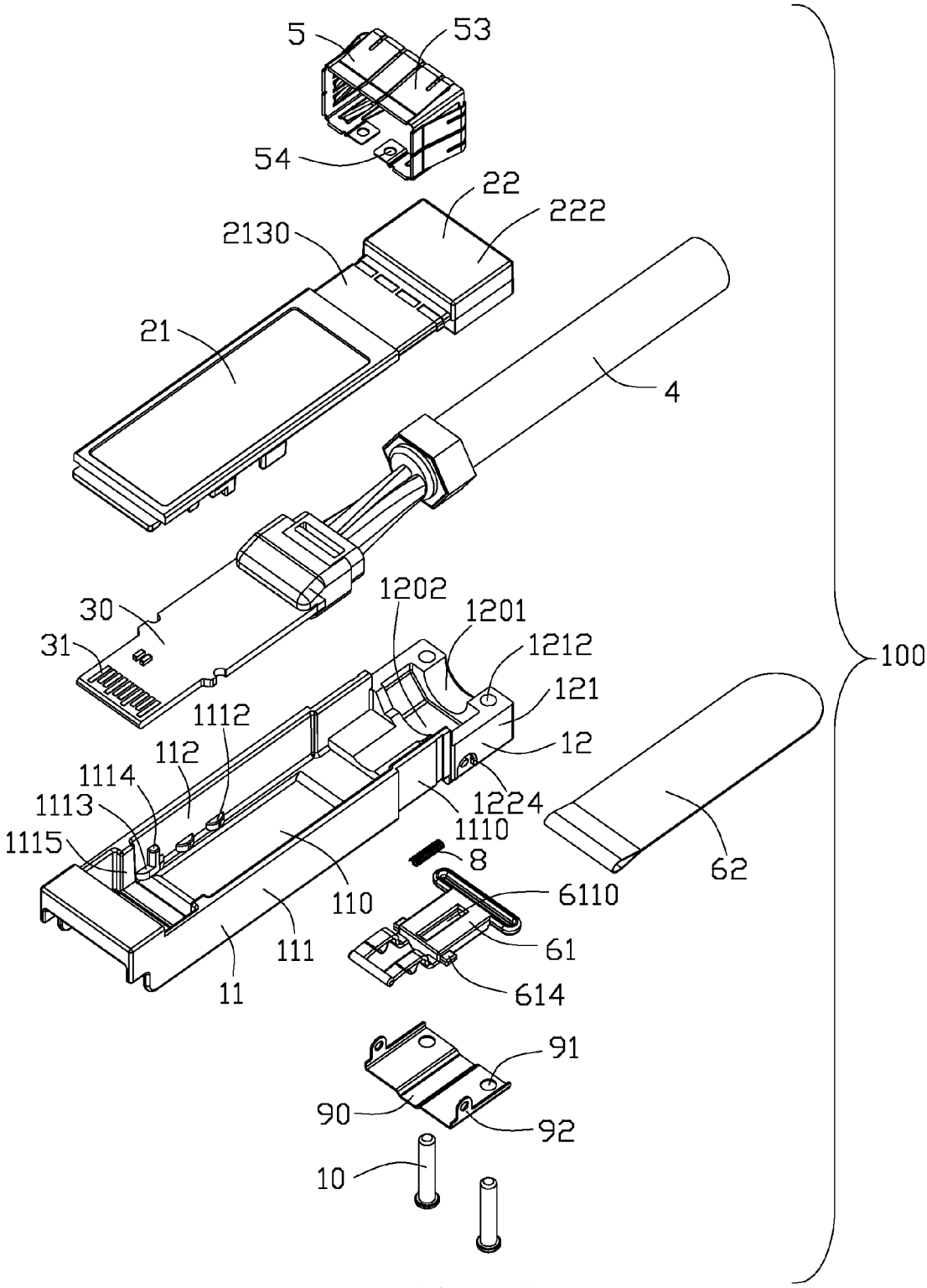
FIG. 2 is another exploded, perspective view of the electronic module of FIG. 1.
Figure 3:
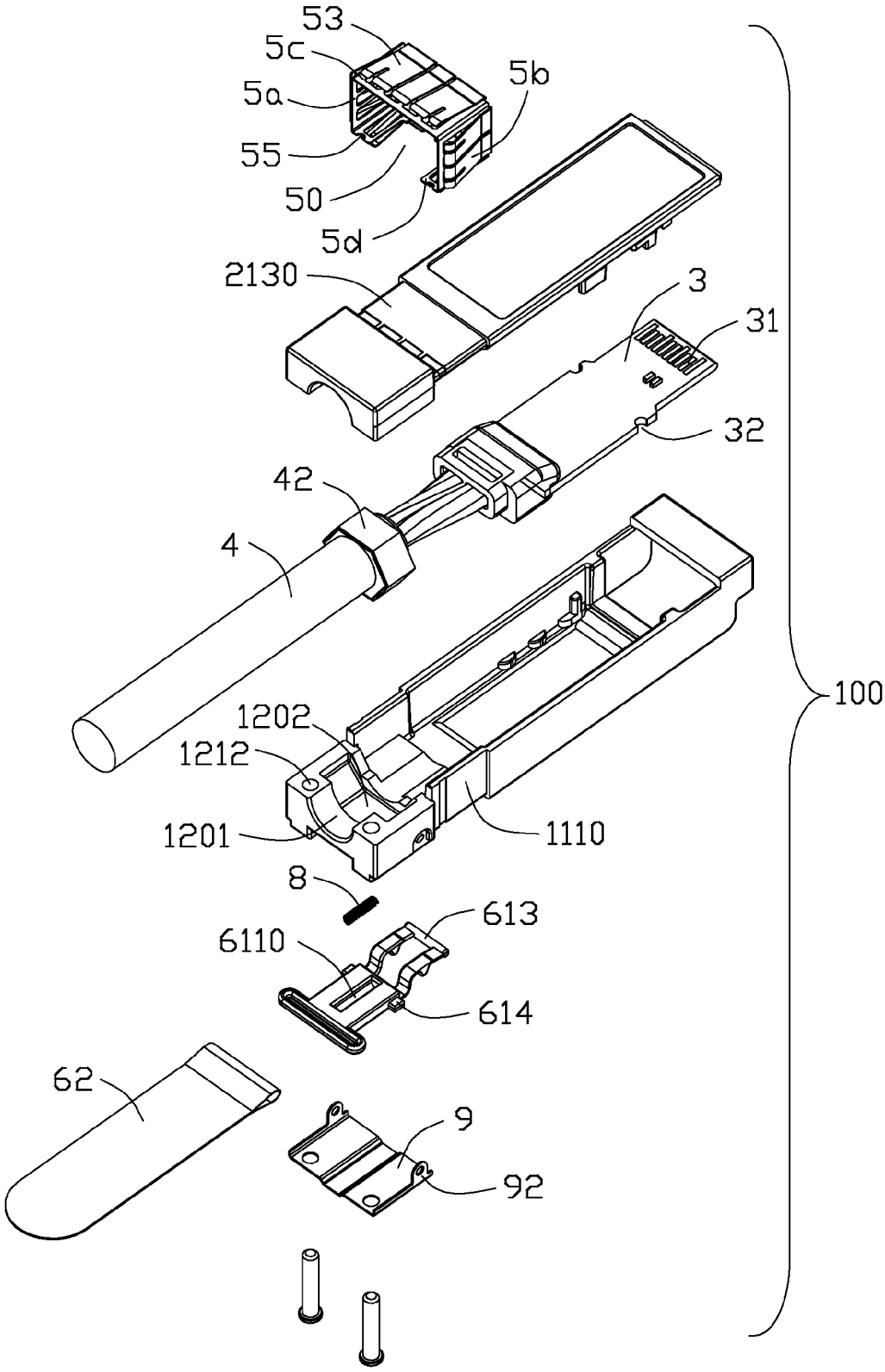
FIG. 3 is another exploded, perspective view of the electronic module of FIG. 2.
Figure 4:
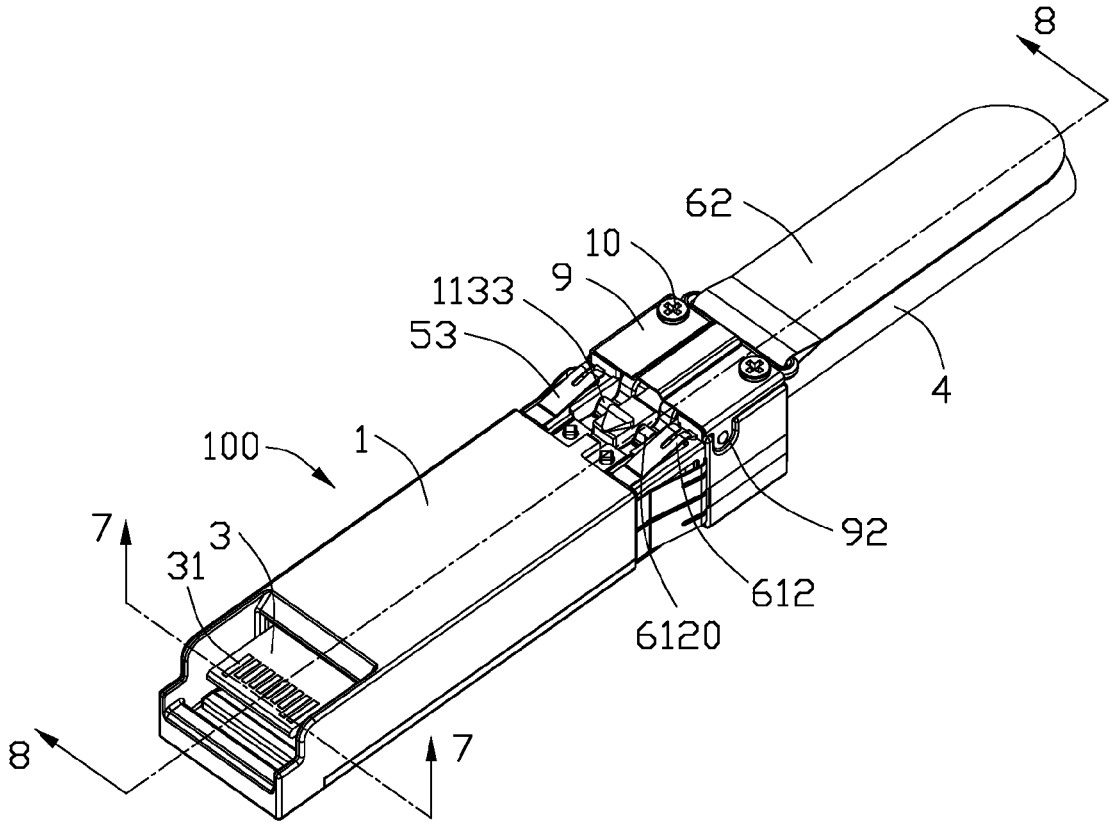
FIG. 4 is an assembled, perspective view of the electronic module shown in FIG. 1.

Reference will now be made in detail to the preferred embodiment of the present invention.

Referring to FIGS. 1-4, the electronic module 100 comprises a housing (not numbered) formed by a conductive base portion 1 and a conductive panel portion 2, a printed circuit board 3, a cable 4, a metallic gasket 5 and a latch mechanism (not numbered). The housing defines a recess area formed on an exterior surface thereof.

Referring to FIGS. 1-4, the base portion 1 is die-cast or other metallic plated body, and includes a primary body portion 11 and a first mounting portion 12 rearward extending from a back face of the primary body portion 11. The primary body portion 11 has a pair of lateral walls 111, 112 and a top wall 113 connecting with the lateral walls 111, 112 to form a receiving space 110 with an opening (not numbered) facing downward. Rear sections of the pair of the lateral walls 111, 112 define a pair of first depression portions 1110. An outlet 1131 is formed on a front section of the top wall 113. A rear section of the top wall 113 defines a first channel 1132 located in a middle area thereof. And, a locking piece 1133 is formed in the front and middle of the first channel 1132. A pair of sunken portions 1134 are formed on two lateral areas of the rear section of the top wall 113, and respectively arranged at two outer sides of the first channel 1132. A pair of indentations 1135 are respectively located at inner side of the corresponding sunken portions 1134 and formed in front of the first channel 1132. And each of the indentation 1135 is deeper than each of the sunken portion 1134. A pair of protrusions 1136 are respectively formed in a rear end of the two sunken portions 1134. A pair of tiny posts 1137 are respectively formed in the pair of indentations 1135. A pair of flutes 1138 are formed on two sides of the first channel 1132 and located on the rear section of the top wall 113. The two flutes 1138 are also respectively located at two inner sides of the two sunken portions 1134 and located behind the two indentations 1135. And, the flute 1138 is deeper than the indentation 1135. A trough 1139 is formed on a front end of the first channel 1132 and communicated with the pair of flutes 1138. Thus, a U-shaped slot is formed by the pair of flutes 1138 and the trough 1139.

The primary body portion 11 further has a beam portion 114 with substantially L-shaped cross-section interconnecting two front ends of the pair of the lateral walls 111, 112. The lateral walls 111, 112 of the primary body portion 11 respectively has two first standoffs 1112 and a second standoff 1113 located in front of the two first standoffs 1112 formed on an inner surface thereof. The two first standoffs 1112 and the second standoff 1113 are located adjacent to the outlet 1131 of the primary body portion 11. And a pair of wider ribs 1115 are respectively formed on two inner surfaces of the lateral walls 111, 112 and disposed in front of each second standoff 1113. Each second standoff 1113 has a situating post 1114 formed thereon. Thus, the second standoff 1113 is structured in a T-shaped. The situating post 1114 formed on the lateral wall 111 and the situating post 1114 formed on the lateral wall 112 are staggered with each other along a longitudinal direction.

The first mounting portion 12 has a pair of side walls 121 and a top wall 122. The first mounting portion 12 defines a first semi-circular cavity 1201 and a first position slot 1202 located in front of the first semi-circular cavity 1201. The first position slot 1202 is deeper than the first semi-circular 1201. A second channel 1221 is formed on a middle area of the top wall 122 and communicated with the first channel 1132 of the primary body portion 11. A projection 1222 is formed in the second channel 1221 and located behind the locking piece 1133. A pair of guiding passages 1223 are formed on two lateral sides of the second channel 1221. And the first mounting portion 12 defines a pair of screw holes 1212 throughout the first mounting portion 12 along a vertical direction and respectively formed at two rear corners thereof. A pair of positioning posts 1224 are respectively formed on exterior surfaces of the pair of side walls 121.

The panel portion 2 is die-cast or a metallic plated body. The panel portion 2 comprises a secondary body portion 21 and a second mounting portion 22 extending rearwards from a back face of the secondary body portion 21. The secondary body portion 21 has a planar board member 213 and a pair of flange members 211, 212 formed on two lateral sides thereof. The board member 213 defines a second depression portion 2130 formed on an outer surface thereof and a vertical wall 2131 perpendicular to the pair of flange members 211, 212 and interconnected with two front ends of the pair of flange members 211, 212. The two flange members 211, 212 respectively defines two supporting post 2133 extending upward from thereon. Four supporting posts 2133 are located behind the vertical wall 2131. A front supporting post 2133 of the two supporting posts 2133 of the flange member 211 has a first aperture 2134 opening facing rearwardly. And a front supporting post 2133 of the two supporting posts 2133 of the flange member 212 has a second aperture 2135 opening facing forwardly. That is to say, the first aperture 2134 and the second aperture 2135 have opposite facing directions with each other. The board member 213 has a protrusion portion 2132 formed on a front end thereof.

The second mounting portion 22 also has a pair of side walls 221 and a bottom wall 22. The second mounting portion 22 defines a second semi-circular cavity 2201 and a second position slot 2202 located in front of the second semi-circular cavity 2201. And the second mounting portion 12 defines a pair of through holes 2211 throughout the second mounting portion 12 along a vertical direction and respectively formed on two rear corners thereof. The recess area is formed by the first depression portions 1110 of the base portion 1 and the second depression portions 2130 of the panel portion 2.

The printed circuit board 3 includes a substrate 30, a plurality of first conductive pads 31 formed on two opposite surfaces of a front section of the substrate 30 and a plurality of second conductive pads (not shown) located on a rear section thereof. A pair of semi-circular positioning holes 32 are formed at two sides of a front segment of the substrate 30. And, the two positioning holes 32 are not in alignment with each other along a transversal direction. That is to say, the two positioning holes 32 are staggered with each other along a longitudinal direction. The shape of the positioning hole 32 also can be defined by other configurations, such as square.

The cable 4 includes an outer insulative jacket 40 and a number of wires 41 enclosed by the insulative jacket 40. And a number of wires 41 are insulated with each other. A cable holder member 42 is attached to the cable 4 and surrounds a front portion of the cable 4. The cable holder member 42 is adjacent to the exposed wires 41. A front section of the wires 41 are electrically connected with the second conductive pads of the printed circuit board 3. And, an insulator 43 is formed around a connection between a front section of the wires 41 and a rear end of the printed circuit board 3.

The gasket 5 is made of metal sheet and has a rectangular frame portion 51. The frame portion 51 defines a pair of vertical sides 5*a*, 5*b*, a lower side 5*c* connecting with the pair of vertical sides 5*a*, 5*b*, and a pair of upper walls 5*d* respectively extending inwardly from two top ends of the pair of vertical walls 5*a*, 5*b*. A number of detents 52, 53 formed on the frame portion 51 are divided into a layer of first detents 53 and a layer of second detents 52. A number of first detents 53 are located on an outer side of the frame portion 51. A number of second detents 52 are located on an inner side of the frame portion 51. A number of second detents 52 are shielded by a number of first detents 53 to achieve better Electro-Magnetic Interference (EMI) suppressing effect. A number of first detents 53 extend rearward and outward from front edge of the frame portion 51. And a number of second detents 52 are stamped from the frame portion 51 and extend rearward and outward. Each upper wall 5*d* defines a circular hole 54 cooperated with the tiny post 1137. Each upper wall 5*d* further defines a semi-circular hole 55 cooperated with the protrusion 1136.

The latch mechanism includes a slider member 61 and a pull tape 62 connected with each other. The slider member 61 is formed of plastic material and has a substantially rectangular body portion 611, two arm portions 612 extending forwardly from a front face of the body portion 611 and a connecting portion 613 connected with two free ends of the two arm portions 612. A U-shaped actuating section is formed by the two arm portions 612 and the connecting portion 613. The two arm portions 612 are made of plastic material and spaced apart with each other along a transversal direction. And, the two arm portions 612 and the connecting portion 613 are respectively received into the two flutes 1138 and the trough 1139. It should be noted that each arm portion 612 is soft and elastic, and structured in a curved shape. The connecting portion 613 is rigid. And, the arm portion 612 will be straightened when the slider member 61 is exerted by a pulling force along a front to rear direction. The arm portion 612 will be resume to an original state when the pulling force is removed. The body portion 611 has a groove 6110 formed on a bottom surface thereof and extending along a front to rear direction. The body portion 611 defines a bar 6111 formed on a top surface thereof and extending along a front to rear direction. The projection 1222 of the base portion 1 is received into the groove 6110 when the slider member 61 is assembled to the base portion 1. Each arm portion 612 has a protrudent portion 6120 formed on a top surface thereof. And the body portion 611 defines a pair of tubers 613 formed on lateral sides thereof and respectively received into the two guiding passages 1223. The slider member 61 can be moved along a front to rear direction.

The pull tape 62 is a soft belt with a certain width. The pull tape 62 defines a connecting end attached to a rear end of the slider member 61 and a handling portion 621 for an operator pulling the latch mechanism.

A spring 8 is received into the groove 6110 and located in front of the projection 1222 and abutted against the projection 1222.

A metallic member 9 is made of metal sheet and defines a notch 90 extending along a front to rear direction to cooperated with the bar 6111 and a pair of openings 91 formed on two sides of the notch 90. The metallic member 9 further defines a pair of connecting portions 92 on lateral sides thereof. The pair of openings 91 are formed in rear segment of the metallic member 9. And the pair of connecting portions 92 are formed at two sides of a front section of the metallic member 9. The two connecting portions 92 are respectively received into the two semi-circular holes of the base portion 1 and engaged with the two positioning posts 1224.

Figure 5:
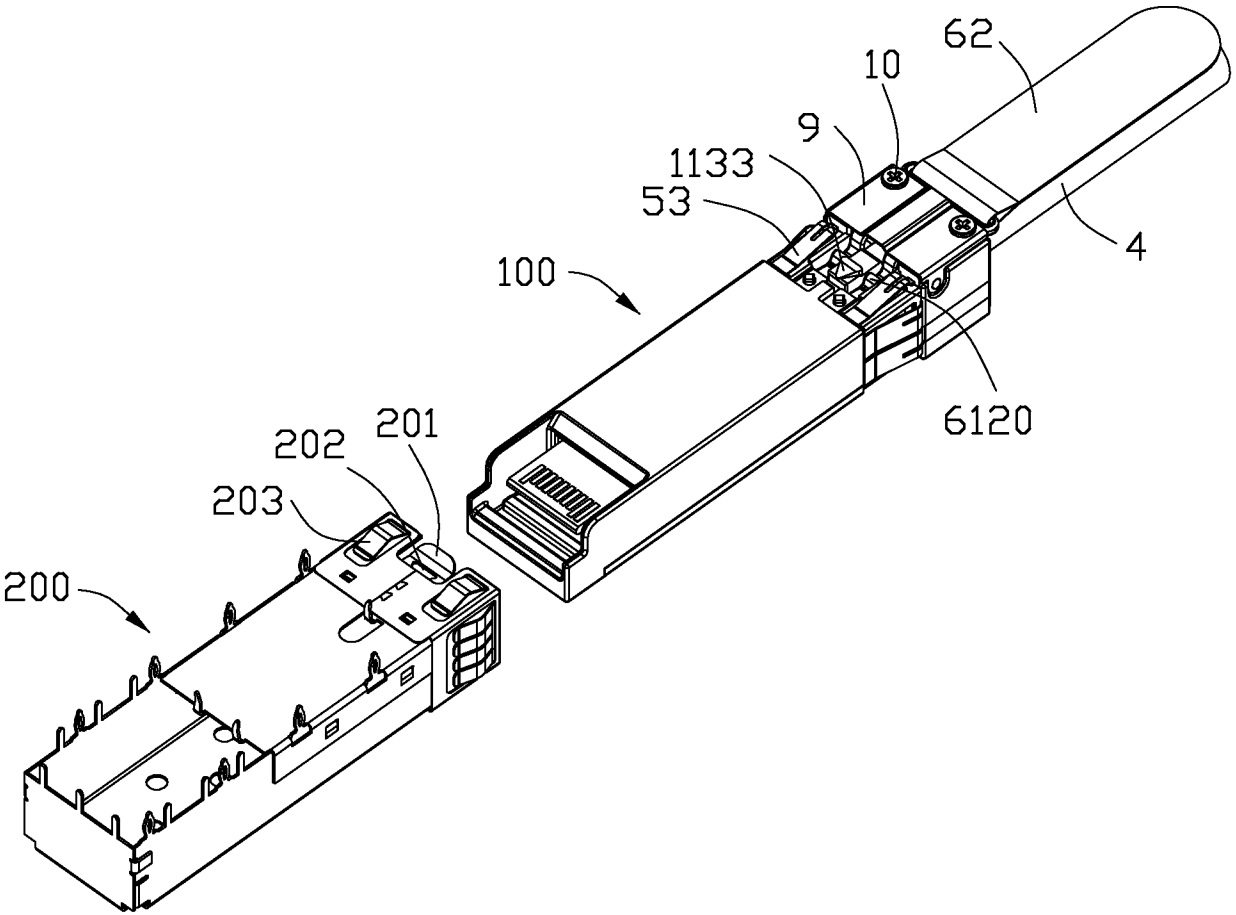
FIG. 5 is an exploded, perspective view of an electrical connector assembly formed by the electronic module shown in FIG. 4 and an cage of a complementary connector.
Figure 6:
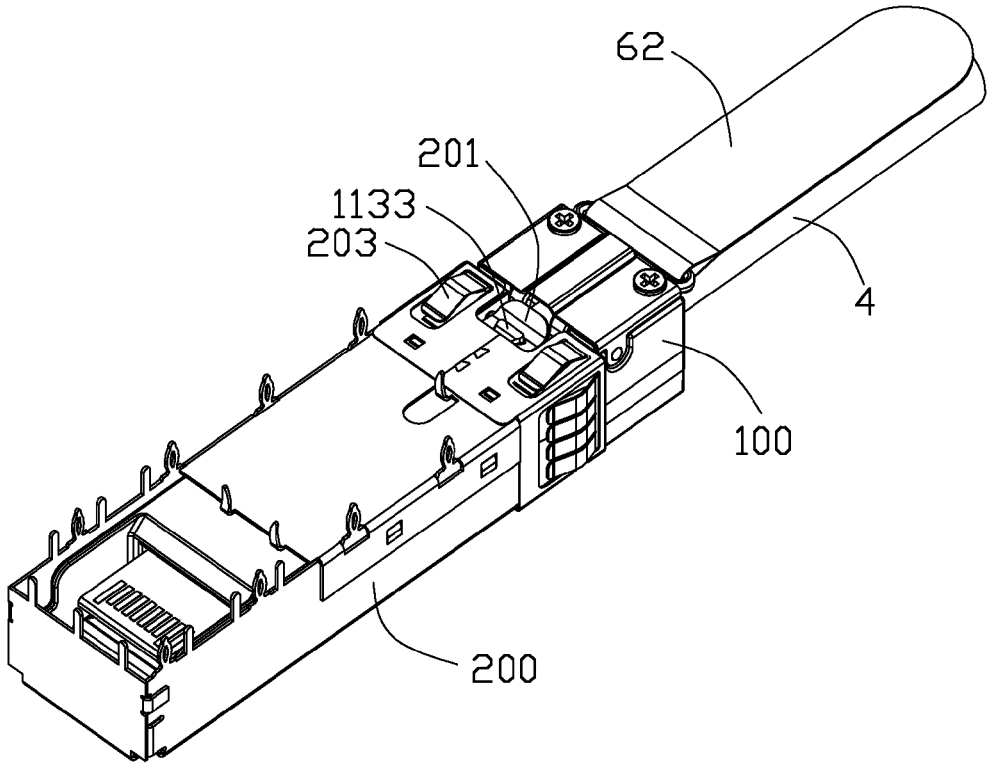
FIG. 6 is an assembled, perspective view of the electrical connector assembly the electronic module and an cage of a complementary connector.
Figure 7:
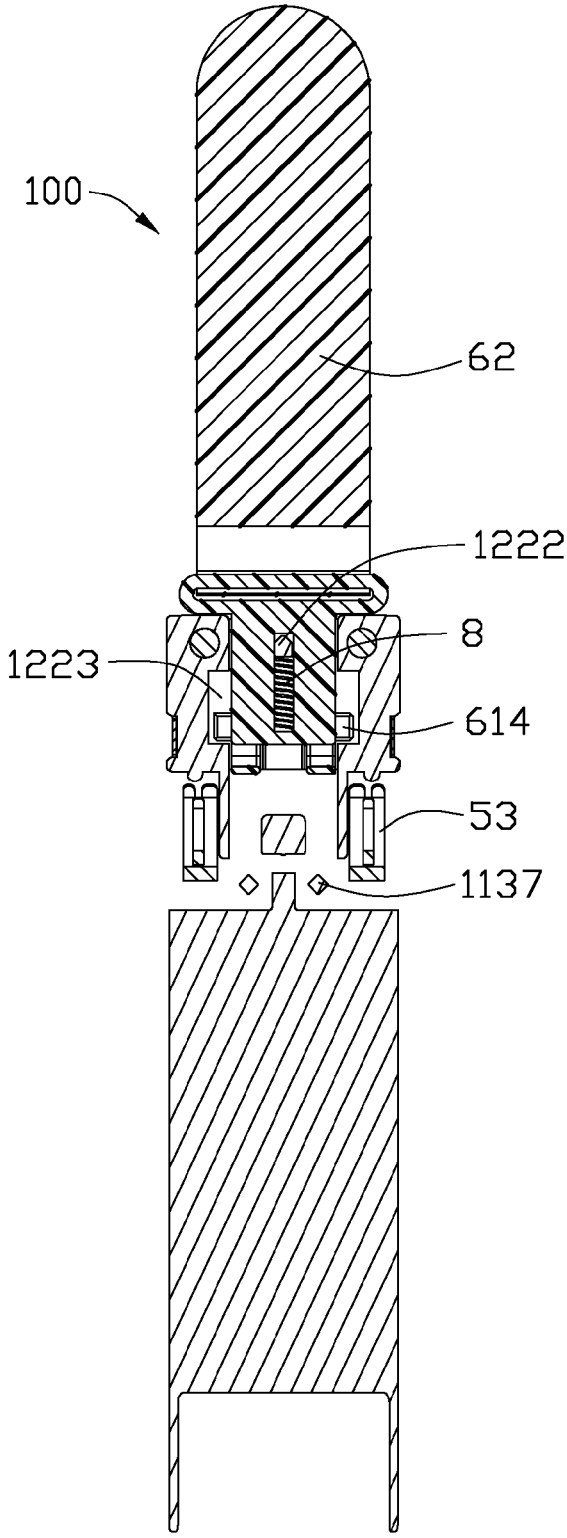
FIG. 7 is a cross-section view taken along line 7-7 of FIG. 4.
Figure 8:
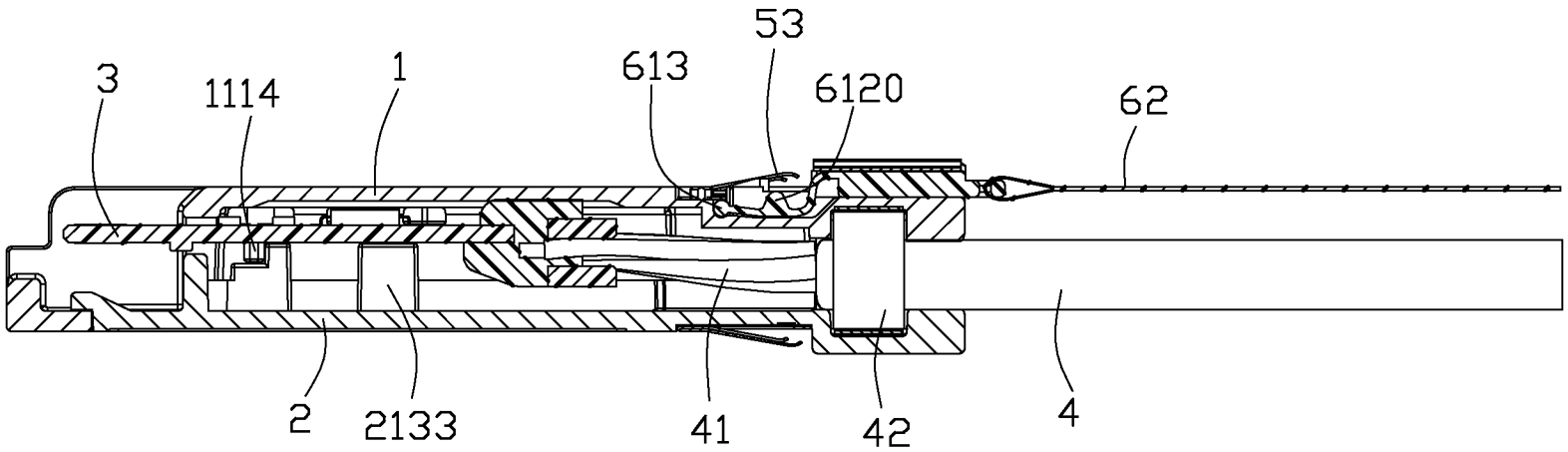
FIG. 8 is a cross-section view taken along line 8-8 of FIG. 4.
Figure 9:
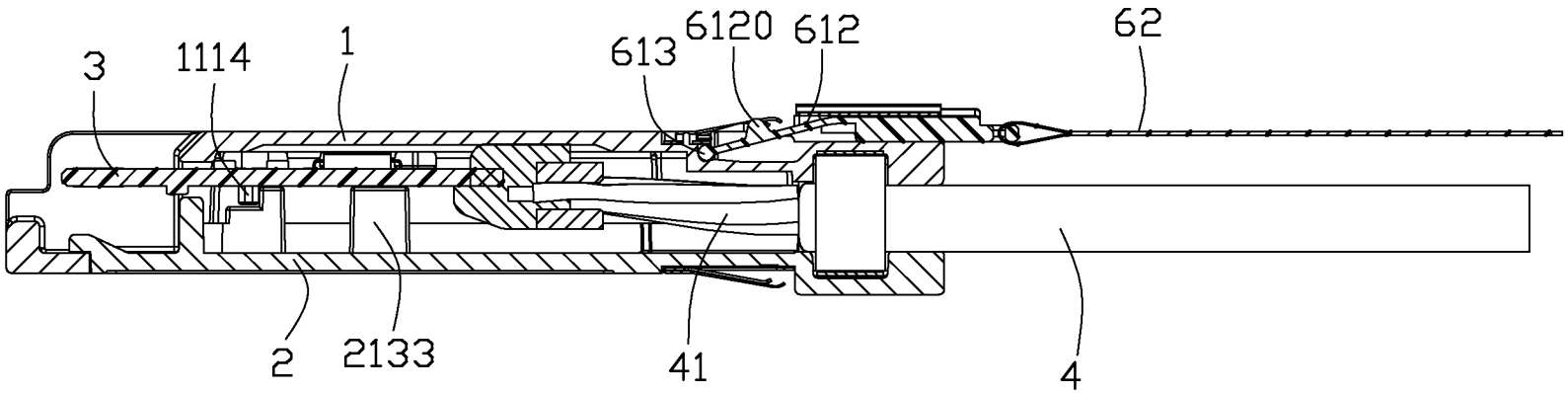
FIG. 9 is a cross-section view of FIG. 8 when a slider member of the electronic module is moved rearwardly.

Referring to FIGS. 5-6, a complementary connector (not shown) mated with the electronic module 100 has a cage 200. The cage 200 is structured in a rectangular shape and has a receiving room formed therein for receiving a body portion of the electronic module 100. The cage 200 defines a first tab 201 having a through hole 202 formed on a rear end thereof and a pair of second tabs 203 located at two sides of the first tab 201 for cooperating with two first detents 53 of the gasket 5.

Referring to FIGS. 1-8, in assembly, the insulative jacket 40 of a front segment of the cable 4 is decorticated. And, then the wires 41 are exposed outside and soldered to the second conductive pads of the printed circuit board 3. And an insulator 43 is formed around a connecting portion between the wires 41 and the printed circuit board 3.

The printed circuit board 3 is assembled into the base portion 1 and received in the receiving space 110 of the base portion 1. Simultaneously, the printed circuit board 3 is located on the first standoffs 1112 and the second standoffs 1113 of the base portion 1. And the situating posts 1114 are inserted into the positioning holes 32 of the printed circuit board 3 to position the printed circuit board 3 to the base portion 1.

The cable holder member 42 of the cable 4 is partially received into the first position slot 1202 of the base portion 1. The panel portion 2 is assembled to the base portion 1 and has a pair of lateral flange members 211, 212 extending into the receiving space 110. The supporting posts 2133 attach to a bottom surface of the printed circuit board 3. The two situating posts 1114 are received into the first and second apertures 2134, 2135. As the first and second apertures 2134, 2135 have different opening facing directions. So the panel portion 2 is positioned with the base portion 1 along a front to rear direction. The protrusion portion 2132 of the panel portion 2 is received into the beam portion 114 of the base portion 1. The cable holder member 42 is totally received into the first and second position slots 1202, 2202.

The slider member 61 is assembled into the second channel 1221 of the first mounting portion 12. The pair of tubers 613 are respectively received into the two guiding passages 1223. The two arm portions 612 of the slider member 61 are received into the pair of flutes 1138. The connecting portion 613 is received into the trough 1139. The spring 8 is received into the groove 6110 of the slider member 61 and disposed in front of and abutted against the projection 1222. The spring 8 will be compressed when the slider member 61 moves rearwardly. The spring 8 will be resumed to an original state when an exerting force is released.

The gasket 5 surrounds the rear out surface of the housing (not figured). The pair of vertical sides 5*a*, 5*b* are received into the pair of first depression portions 1110. The lower side 5*c* is received into the second depression portions 2130 of the panel portion 2. The pair of upper walls 54 are respectively received into the pair of sunken portions 1134 and indentations 1135. The tiny post 1137 formed in the indentation 1135 is passed through the circular hole 541. Thus, the gasket 5 is fixed to the housing. The pair of protrusions 1136 are received into the pair of semi-circular cutouts 542 of the upper wall 5*d*. The protrudent portion 6120 of the arm portion 612 is disposed below the first tab 201.

The metallic member 9 is assembled to a top surface of the first mounting portion 12 and covered to the body portion 611 of the slider member 61. The bar 6111 of the body portion 611 is received into the notch 90. The pair of connecting portions 92 are cooperated with the pair of positioning posts 1224. The opening 91, the screw hole 1212, the through hole 2211 are in alignment with each other along a vertical direction. A pair of screws 10 are respectively passed through the opening 91, the screw hole 1212, the through hole 2211 to engage with the metallic member 9, the base portion 1 and the panel portion 2 together. Through above assembling steps, the entire process of assembling of the electronic module 100 is finished.

When the electronic module 100 is received into the cage 200 of the complementary connector, the locking piece 1133 is passed through the through hole 202 of the first tab 201. Thus, the electronic module 100 is interlocked with the cage 200. And, the arm portion 612 will be straightened when the slider member 61 is exerted by a pulling force along a front to rear direction. And, the first tab 201 will be raised up by the protrudent portion 6120 which is moved upwardly. At this time, the locking piece 1133 is disengaged with first tab 201. As a result, the electronic module 100 can be discreted from the cage 200.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electronic module for mating with a complementary connector, comprising:

a housing defining a recess area;

a printed circuit board disposed in the housing;

a slider member assembled to an exterior surface of the housing and defining a pair of curved arm portions formed on a front section thereof and a connecting portion connected with two front ends of the pair of curved arm portions, each arm portion defining a protrudent portion formed on a top surface thereof;

a gasket received into the recess area and engaged with the housing;

whereby movement of the slider by a user along a front to rear direction, the pair of curved arm portions are both straightened to make two protrudent portions moved upwardly.

2. The electronic module as claimed in claim 1, wherein the electronic module further comprises a pull tape attached to a rear end of the slider member for the user operating.

3. The electronic module as claimed in claim 1, wherein the electronic module further comprises a cable electrically connected to a rear end of the printed circuit board.

4. The electronic module as claimed in claim 1, wherein the electronic module further comprises a metallic member assembled to the housing and covering a portion of the slider member.

5. The electronic module as claimed in claim 4, wherein the housing comprises a base portion and a panel portion assembled with each other along a vertical direction, the printed circuit board is sandwiched between the base portion and the panel portion.

6. The electronic module as claimed in claim 5, further comprising a pair of screws interconnecting with the metallic member, the base portion and the panel portion.

7. The electronic module as claimed in claim 1, wherein the housing defines a locking piece formed on the exterior surface and disposed between the two arm portions of the slider member along a transversal direction for locking with a cage of the complementary connector.

8. The electronic module as claimed in claim 1, wherein the gasket defines a number of first detents located on an outer side thereof and a number of second detents located on an inner side thereof.

9. The electronic module as claimed in claim 1, wherein the slider member defines a groove formed on a bottom surface thereof, a spring is received into the groove and abutted against a projection formed the exterior surface and received into the groove.

10. The electronic module as claimed in claim 1, wherein the pair of curved arm portions of the slider member are elastic and received into the two flutes formed on the exterior surface, and the connecting portion is rigid and received into a trough communicated with two flutes.

11. An electronic module for engaging with a cage of a complementary connector, comprising:

a housing having a channel formed on an exterior surface thereof and defining a generally U-shaped slot formed on the channel;

a printed circuit board disposed in the housing;

a slider member received into the channel, and defining a body portion and a front actuating portion extending forwardly from the body portion, the front actuating portion received into the U-shaped slot, the front actuating section defining two elastic and curved arm portions; and a gasket surrounding the housing and engaged with the housing;

whereby when the slider member is pulled, said two curved arm portions are straightened for deflecting a tab of the cage moving upwardly.

12. The electronic module as claimed in claim 11, wherein each arm portion of the slider member defines a protrudent portion formed thereon and moved upwardly when the arm portion is straightened.

13. The electronic module as claimed in claim 11, the housing comprises a base portion and a panel portion assembled with each other, the electronic module further comprises a metallic member covering the body portion of the slider member.

14. The electronic module as claimed in claim 13, wherein the electronic module further comprises a pair of screws interconnecting the metallic member, the base portion and the panel portion together.

15. The electronic module as claimed in claim 11, wherein the electronic module further comprises a cable electrically connected to a rear end of the printed circuit board.

16. The electronic module as claimed in claim 11, wherein the front actuating section further defines a connecting portion connected with two front ends of the two arm portions.

17. An electrical module for use within a cage having a deflectable locking tab thereof, comprising:

a housing defining a mating port forwardly communicating with an exterior in a front-to-back direction;

a locking piece formed on an exterior surface of the housing for locking to the deflectable locking tab of the cage;

a slider member assembled to the housing and back and forth moveable along the front-to-back direction;

a flexible piece formed on a front portion of the slider member around the locking piece; and a front end of said flexible piece being fixed to the housing in an immoveable manner while a rear end is fixed to the slider member in a moveable manner; wherein the flexible piece is ordinarily in an inward relaxed manner for not outwardly deflecting the locking tab of the cage while via rearward movement of the slider member in the front-to-back direction, the flexible piece is converted to an outward forced manner for outwardly deflecting the locking tab of the cage to release locking between the locking piece and the locking tab of the cage.

18. The electrical module as claimed in claim 17, wherein the flexible piece is unitary with the slider member.

19. The electrical module as claimed in claim 17, wherein the flexible includes a protruding portion for abutting against the locking tab of the cage.

20. The electrical module as claimed in claim 17, wherein said slider member is equipped with a spring to urge the slider member forwardly.

* * * * *